United States Patent [19]

Östbo

[11] Patent Number: 4,962,296

[45] Date of Patent: Oct. 9, 1990

[54] HEAT EXCHANGER

[76] Inventor: Karl Östbo, Fredhallsgatan 7, Stockholm, Sweden, 11254

[21] Appl. No.: 264,978

[22] Filed: Oct. 31, 1988

[30] Foreign Application Priority Data

Aug. 26, 1983 [SE] Sweden ..... 8304626

[51] Int. Cl.[5] ..... F24H 1/12; F24H 3/06; F28F 21/08

[52] U.S. Cl. ..... 219/306; 219/365

[58] Field of Search ..... 219/296, 298, 299, 302, 219/305, 306, 271, 374, 375, 376, 381, 382, 530, 540, 365; 165/154, 164, 165, 183

[56] References Cited

U.S. PATENT DOCUMENTS

| | | | |
|---|---|---|---|
| 646,911 | 4/1900 | Knox | 219/299 |
| 758,946 | 5/1904 | Watermann | 219/298 |
| 1,821,434 | 9/1931 | Hamilton | 165/183 |
| 1,840,651 | 1/1932 | Bassler | 165/165 |
| 1,847,489 | 3/1932 | Lonergan | 219/305 |
| 1,952,896 | 3/1934 | Rudorff | 165/183 |
| 2,307,924 | 1/1943 | Gillespie | 219/298 |
| 2,405,722 | 8/1946 | Villier | 165/183 |
| 2,421,562 | 6/1947 | Hynes | 219/305 |
| 2,606,992 | 8/1952 | MacDonald | 219/365 |
| 2,779,972 | 2/1957 | Kins | 165/164 |
| 3,467,180 | 9/1969 | Pensotti | 165/183 |
| 3,493,042 | 2/1970 | Burne et al. | 165/180 |
| 3,602,298 | 8/1971 | Ciesielski | 165/164 |
| 4,487,256 | 12/1984 | Lutjens et al. | 165/76 |

FOREIGN PATENT DOCUMENTS

| | | | |
|---|---|---|---|
| 979059 | 12/1975 | Canada | 219/299 |
| 1558292 | 3/1970 | Fed. Rep. of Germany | 165/183 |
| 69269 | 10/1958 | France | 165/183 |
| 69567 | 11/1958 | France | 165/183 |
| 74384 | 11/1960 | France | 165/183 |
| 1534246 | 7/1968 | France | 165/183 |
| 3960-72 | 9/1973 | Sweden | 165/181 |
| 1209739 | 10/1970 | United Kingdom | 165/183 |
| 1379511 | 1/1975 | United Kingdom | 165/181 |

*Primary Examiner*—A. D. Pellinen
*Assistant Examiner*—G. Evans
*Attorney, Agent, or Firm*—Fleit, Jacobson, Cohn, Price, Holman & Stern

[57] ABSTRACT

In order to improve the transfer of heat within a heat exchanger, one or more tubes (11) for a heat transporting medium are embedded by casting into a block (12*a*) of an aluminum alloy or some other metal having a high heat-conducting capacity. The block is at its outward faces provided with surface-enlarging flanges (15), and is enclosed in a casing (13) which defines a passage for a second heat-transporting medium flowing around the block (12*a*). A block can be prismatic or annular, and a number of blocks can be fitted within the same casing. In one embodiment, electric resistance elements are provided within the embedded tubes as a first heat-transporting medium in order to obtain an electrically heated heat exchanger, with the second heat-transporting medium being for example oil.

5 Claims, 6 Drawing Sheets

FIG. 8
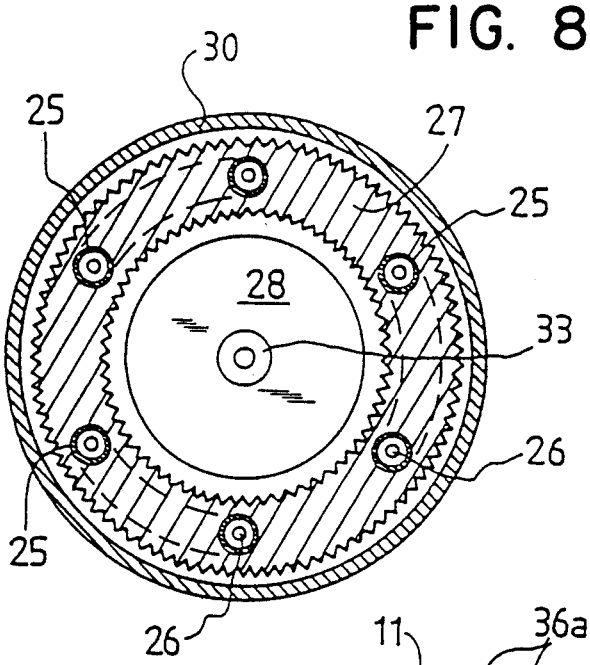
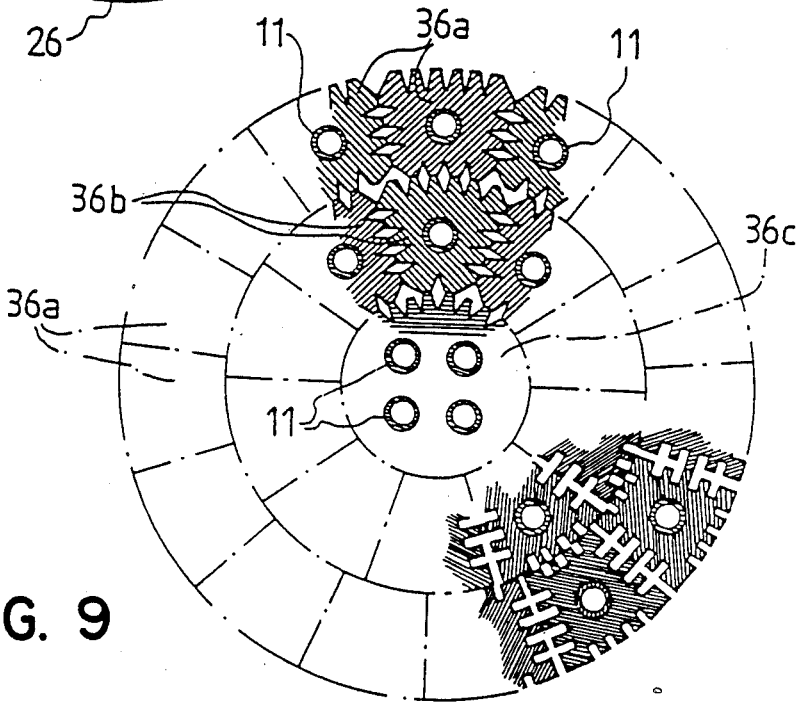
FIG. 9

FIG. 10
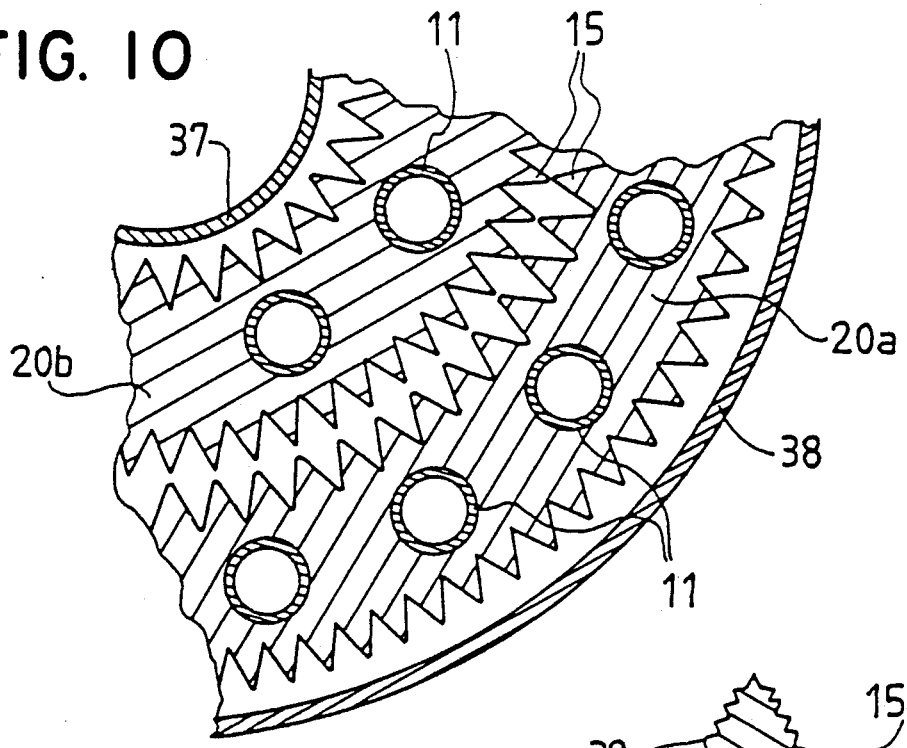
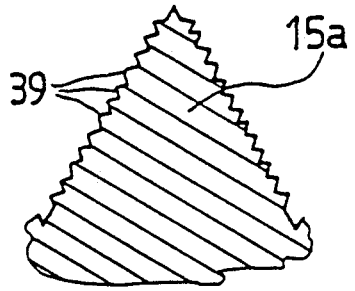
FIG. 11
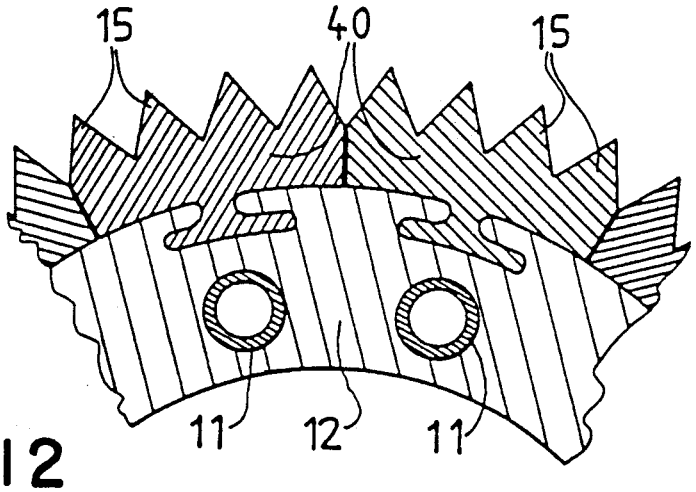
FIG. 12

HEAT EXCHANGER

This is a divisional of prior application Ser. No. 07/104,542 filed Oct. 1, 1987, now U.S. Pat. No. 4,782,892 issued Nov. 8, 1988 which in turn was a divisional of prior application Ser. No. 06/726,904 filed April 16, 1985 and now abandoned which steemed from PCT International Application No. PCT/SE84/00282 filed Aug. 22, 1988.

BACKGROUND OF THE INVENTION

This invention relates to heat exchangers, and more particularly to heat exchangers having high heat transmission properties.

The heat transfer between two heat transporting media is influenced by many factors, but it is obvious that it is advantageous to provide for a good contact between the various components. When the transportation path includes components of different kinds and possibly also of different materials the inventor has found that a superior method of ensuring a high heat conductivity is to embed one component into another by casting.

BRIEF SUMMARY OF THE INVENTION

The object of the present invention is to provide a heat exchanger having high heat transmission properties, and which is characterized in that the core includes at least one block of metal having a high heat conducting capacity, into which at least one tube for the first medium is embedded by casting, and which at its inward and/or outward face is provided with surface enlarging flanges to present contact surfaces towards the second medium several times larger than what the tube(s) presents towards the first medium.

The block may be prismatic and encloses a number of tubes. Alternatively the block may be annular.

In order to improve the heat transfer from, or to, a block, in which the flanges run in parallel to its longitudinal axis the flanged face of the block is cut transversely by grooves subdividing the face into fields, or, sections, wherein the flanges in one section are displaced sidewardly so as to be aligned with the grooves in an adjacent section in order to provide a tortuous flow path for the second medium along said face of the block.

The bonding between the tube and the metal as well as the heat transfer therebetween is enhanced by the outward face of the tube being rugged. The tube is preferably made of stainless steel, which is better suited than the material in the block to withstand corrosion, and which also has good bonding properties with respect to the enclosing metal.

A number of flanges can advantageously be formed in an extruded bar of metal, adapted, together with further bars, to form a mold into which the tube enclosing block is cast.

In a heat exchanger comprising a number of blocks mounted within the same casing the flanges in one of the blocks may extend into gaps between flanges in another block. Alternatively the flanges at juxtaposed blocks faces may meet edge to edge.

A number of panel-shaped blocks, each including at least one row of first medium transferring tubes may be fitted within a casing, which is passed through by a heat transporting gas, and where the tubes are connected to distribution and collecting headers for the first fluid.

The first heat trnasporting medium may be electric current, in which case a number of tubes enclosing electric resistances are cast into a tubular block, which is interiorly and exteriorly contacted by a heat removing fluid.

BRIEF DESCRIPTION OF THE DRAWINGS

The invention will now be described in detail with reference to the accompanying drawings, wherein:

FIG. 8 is a cross section through the heat exchanger according to FIG. 7, FIG. 9 shows a cross section through a heat exchanger core composed of several elements, and suited for example for use with a heat exchanger according to FIG. 7, FIG. 10 shows a detail of a heat exchanger formed by two heat exchanger elements according to FIG. 5, FIG. 11 shows, on a larger scale, a detail of surface-enlarging flange of a heat exchanger element, FIG. 12 shows a detail of an element where the surface-enlarging flanges are formed in profile bars usable as a mold when casting the element.

DETAILED DESCRIPTION

Figure 1:
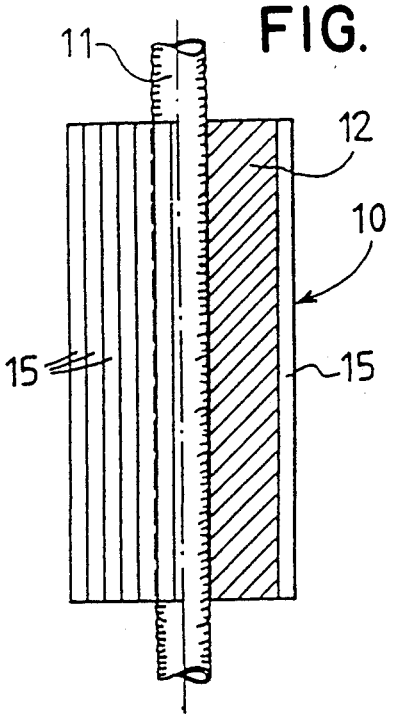
FIG. 1 schematically shows a heat exchanger element according to the invention.

FIG. 1 shows a basic type of heat exchanger element 10, comprising a tube 11 for a first heat transferring medium, which is cast into a block 12 of a metal having good heat conducting capacity, for example aluminum or some alloy thereof. This element will be mounted in a casing 13 (FIG. 2), which encloses the element with a clearance 14, so that a passage for a second heat transporting medium is formed. Alternatively, a number of such elements may be mounted in spaced relationship.

A better bonding between the tube and the metal, and also an improved heat transfer is obtained if the outward face of the tube 11 is roughened or provided with transversely running rills.

Flanges will increase the contact surface area in relation to the second medium, to five to ten times that of the contact area between the tube 11 and the first medium. That will compensate for the difference in heat transfer coefficients, which often puts a limit to the heat load upon heat exchangers.

In order to improve the heat transfer to the second medium the block is provided with flanges 15. Depending upon the direction of flow of the second medium the flanges may be arranged in parallel to, or perpendicularly to the longitudinal axis of the tube 11. On occasions when the block is tubular, the flanges may possibly run in a helical path around the outer envelope face of the element. The flanges are preferably formed during the casting, but may be formed by mechanical working.

Figure 7:
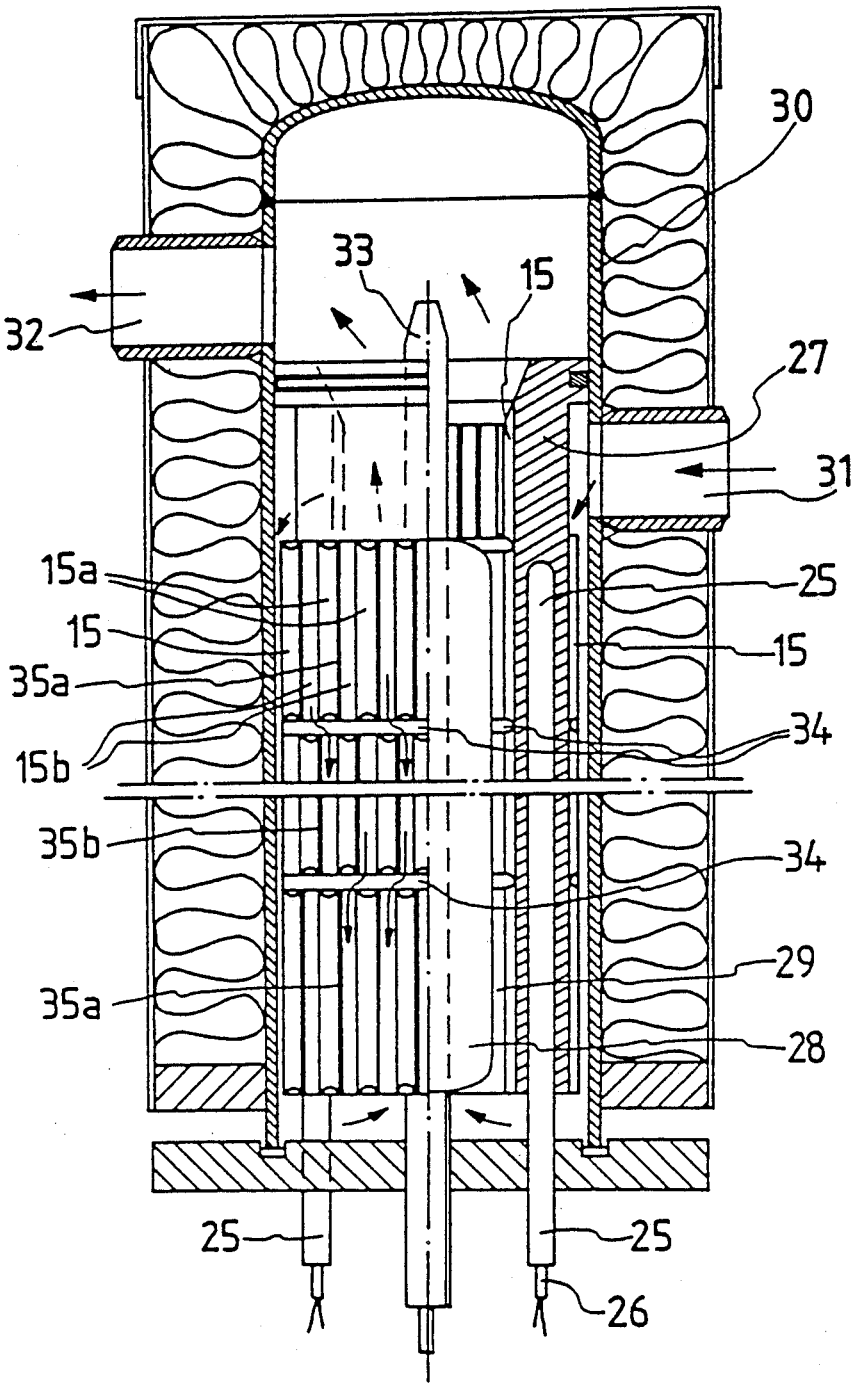
FIG. 7 shows a longitudinal section through a exchanger with electric resistance elements.

As will be better explained in conjunction with FIG. 7 the flanges should be preferably not run uninterruptdidly along the face of the blocks, but should be staggered so as to provide a tortuous flow for the second medium.

Figure 3:
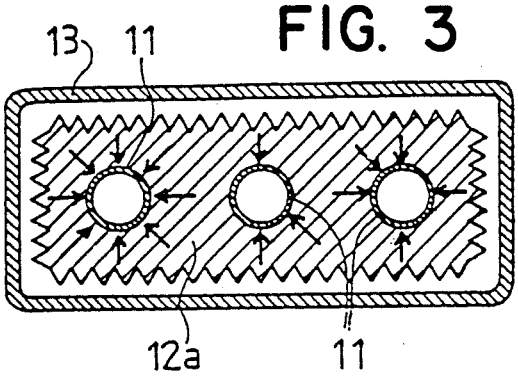
FIG. 3 shows a cross section through a heat exchanger, similar to that of FIG. 2, but having a bigger element.

A number of elements of the basic tupe shown in FIG. 1, and having varying cross sectional shapes may be built together within a common casing, but it is also possible, as is indicated in FIG. 3, to embed a number of parallel tubes 11 within the same block 12*a*, to be located in an enclosing casing 13.

Figure 2:
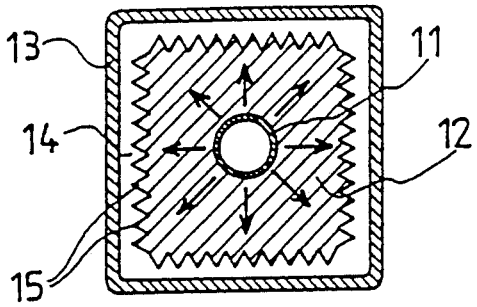
FIG. 2 shows a cross section through a heat exchanger containing an element according to FIG. 1.

In FIGS. 2 and 3 arrows directed radially towards, or away from the tubes, will indicate the direction of the concentrated flow of the heat around the tubes. Due to the intimate metallic contact between the two components the heat transfer will be very intense.

Figure 4:
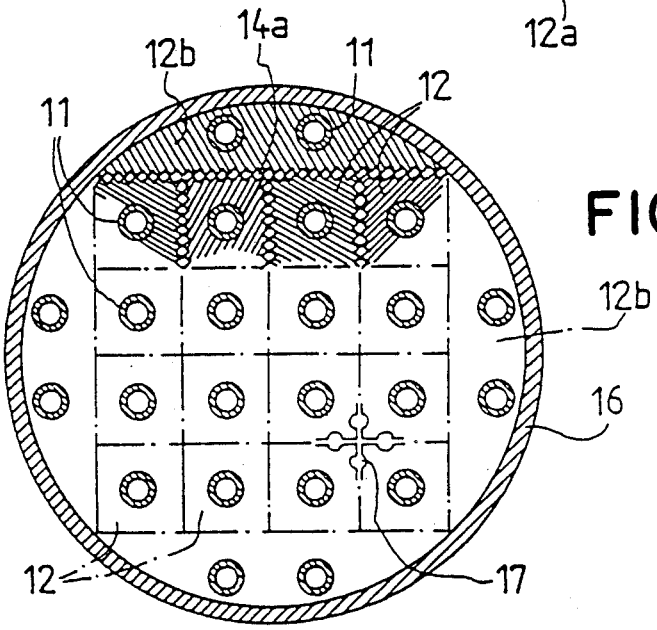
FIG. 4 shows a heat exchanger having elements of a modified form.

FIG. 4 shows a heat exchanger containing a number of elements 12 according to FIG. 1, as well as four elements 12*b* of a specific shape, which together form a cylindrical body enclosed in a tube 16, which holds the various components together.

Passages 14*a* for the second heat transferring medium will remain between the various elements. The tubes 11 may be connected in parallel, but can, for example, be in groups connected in series. On such occasions suitable distribution and collecting headers are provided at the ends of the elements.

The heat exchanger package shown in FIG. 4 may be enclosed in a casing, which defines a flow path for the second heat transferring medium, outside the tube 16. The flanges 15 may be shaped in different ways, and as indicated at 17 in the lower, right part of the figure, they may be defined by half-circular grooves.

Figure 5:
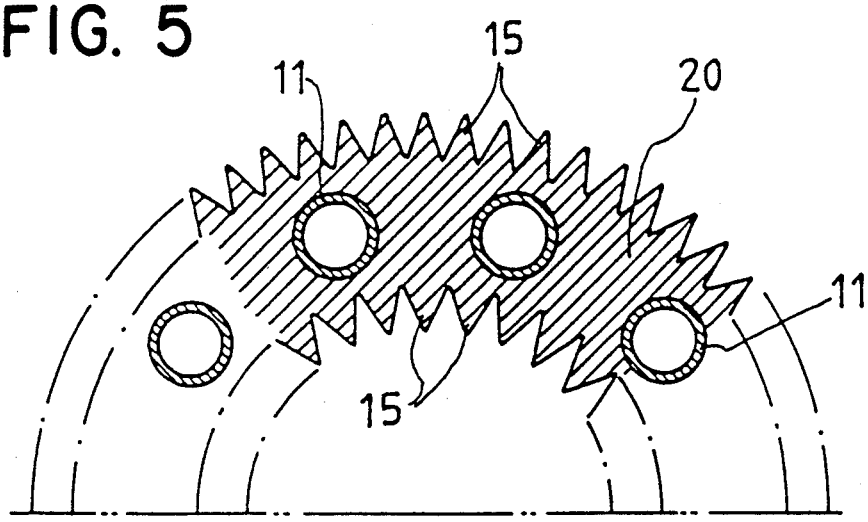
FIG. 5 shows a detail of a heat exchanger element of a further modified form.

FIG. 5 shows annular block 20, in which a number of tubes 11 are embedded. This block is interiorly, as well as exteriorly, provided with surface-enlarging flanges 15.

Figure 6:
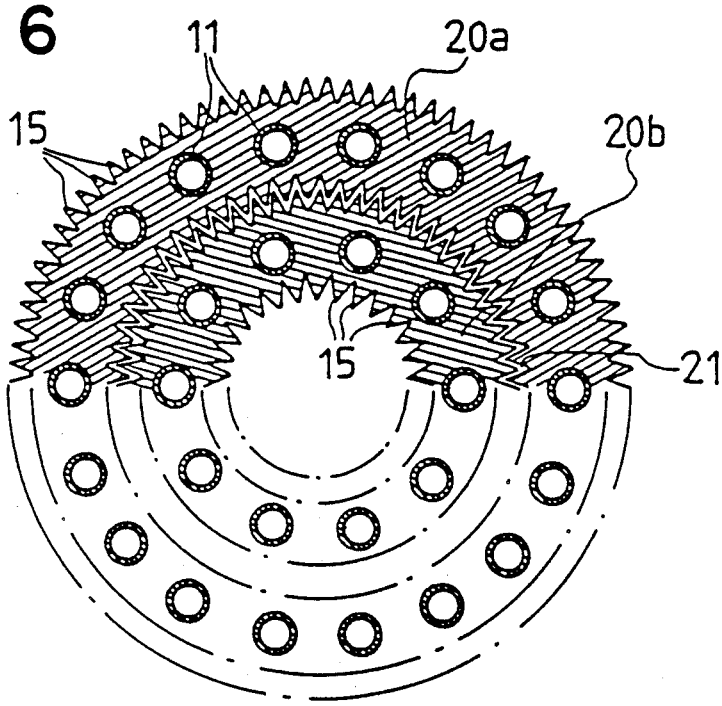
FIG. 6 shows a detail of a heat exchanger having heat exchanger elements according to FIG. 5.

FIG. 6 shows components for a heat exchanger comprising concentric annular blocks 20*a*, 20*b* of different diameters. The blocks are fitted together, so that the flanges 15 of one element fit into the gaps between flanges 15 at the other element. In this manner a restricted zig-zag shaped passage 21 for the second heat transferring medium will be formed between the blocks.

In the embodiments described above the tubes 11 have been adapted to receive a fluid—in form of a liquid or as steam—but the first heat transferring medium can very well be electric current, which by embedded resistance elements in transformed into heat.

FIGS. 7 and 8 show an electrically heated oil preheater. Three tubes 25, bent into U-shape, and enclosing electrical resistances 26 are embedded in an annular block 27 of the same type as that shown in FIG. 5, and here provided with internal and external surface-enlarging flanges 15. A filler body 28 is fitted centrally in the block, and defines a passage 29 along the inward face of the block.

Oil is introduced into the enclosing casing 30 at 31, and flows exteriorly around the block 27, makes a 180° turn, an flows through passage 29 towards an exit 32.

A temperature sensor 33 extends radially centrally through the filler body and presents its inward end adjacent to the exit 32. The sensor will in a well known manner govern the supply of electric current to the resistance 26.

A smooth flow along a surface may tend to provide a poor heat transfer, and in order to improve the heat transfer the flanged face of a block is preferably cut up into fields where the flanges in one field are displaced sidewards so as to be aligned with the grooves in a following field, whereby a tortuous flow of the second medium is ensured.

In FIG. 7 the outward, as well as the inward face of the annular block 27 is cut by grooves 34, transversely to the longitudinal axis of the block. In this manner the contact faces of the block are subdivided into sections 35*a, b*, in which the flanges 15*a* of one sections are displaced sidewards so as to be aligned with the grooves 15*b* of the adjacent sections.

A limiting factor with conventional electric oil heaters, where the resistance-enclosing tubes come into direct contact with the oil, is that the load cannot exceed 1,5–2 W/cm$^2$. Otherwise there is an apparent risk of the oil coking at the outward face of the tube.

In the present embodiment the load upon the block 27 faces can remain at a value which is safe with respect to coking, but the load upon the electric resistances can be increased considerably, which means that the overall size of the heat exchangers, for the same heating capacity, will be much smaller than a conventional electric oil heater.

FIG. 9 shows a further modified embodiment composed of a number of cast blocks 36*a*, 36*b*, 36*c*, enclosing a number of tubes 11. This embodiment may be regarded as a modification of that shown in bar-like members.

The central block 36*c* may very well be used instead of the filler body 33 of the embodiment according to FIGS. 7 and 8.

On many occasions U-shaped tubes with enclosed electric resistances as indicated in FIG. 8—are preferable. The shape of a block will then be more like that of FIG. 3, where the central tube void may house the temperature sensor, while the two outer tube voids are united into a U-shape.

FIG. 10 shows a detail of a modified arrangement of components similar to those of FIG. 6. Here, however, the annular blocks 20*a*, 20*b* are fitted so that flanges 15 meet edge to edge.

The blocks are here fitted between inner and outer casings 37 and 38, respectively.

As is mentioned above the flanges can be differently shaped. With bigger units it is possible to provide also the individual flanges 15*a* with ribs or fins 39 — see FIG. 11—in order further to enlarge the contact surface passed by the second medium.

On occasions it may, as is shown in FIG. 12, be advantageous to locate the flanges 15 on separate, extruded profile bars 40 of the same meaterial as the block 12. These profile bars are shaped and arranged to permit them being used as an exterior mold for casting the block and will adhere permanently thereto. This will simplify the casting of bigger units, and also make them cheaper than units cast as unitary bodies with flanges. It will sometimes be difficult to remove a flanged block from an enclosing mold, but by using the flange-bearing bars to form part of first the mold and then the block, this difficulty is overcome.

In the embodiments described above the second medium has been a fluid, but the invention may also be used with heat exchangers where the second medium is gaseous, for example exhaust gases from an internal combustion engine or a process plant.

Figure 13:
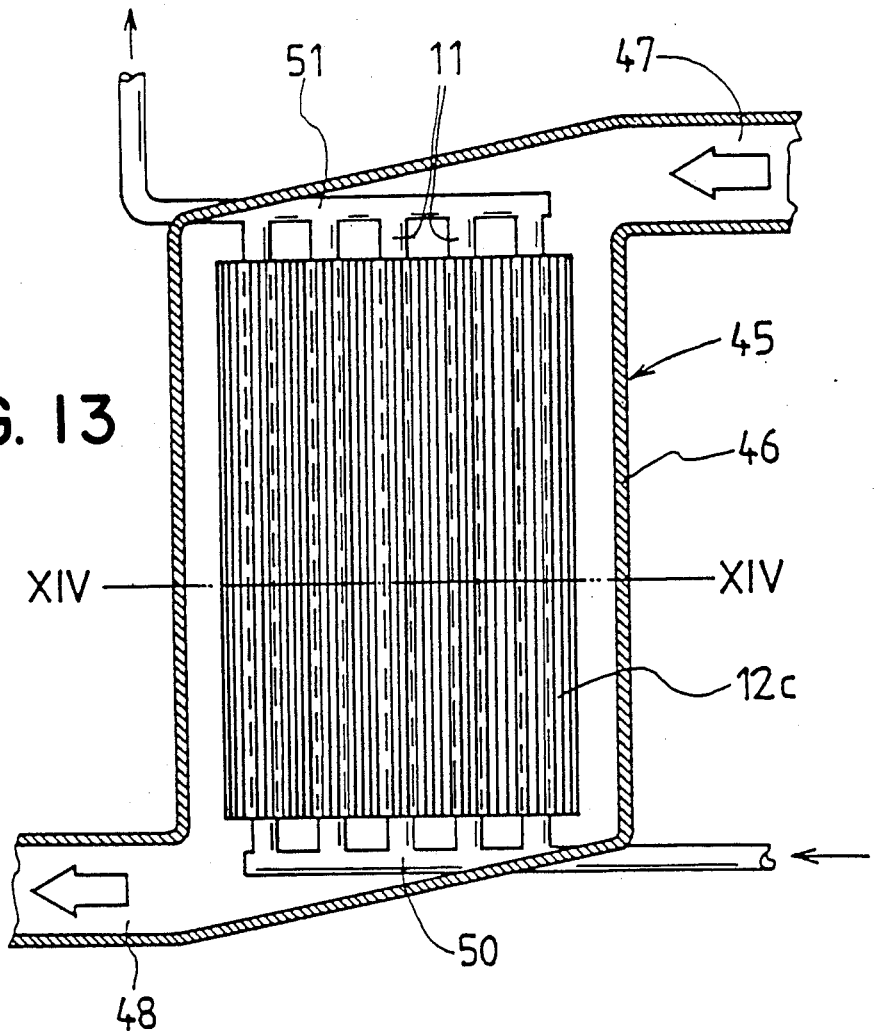
FIG. 13 shows a section through a heat exchanger according to the invention as used in an exhaust boiler.
Figure 14:
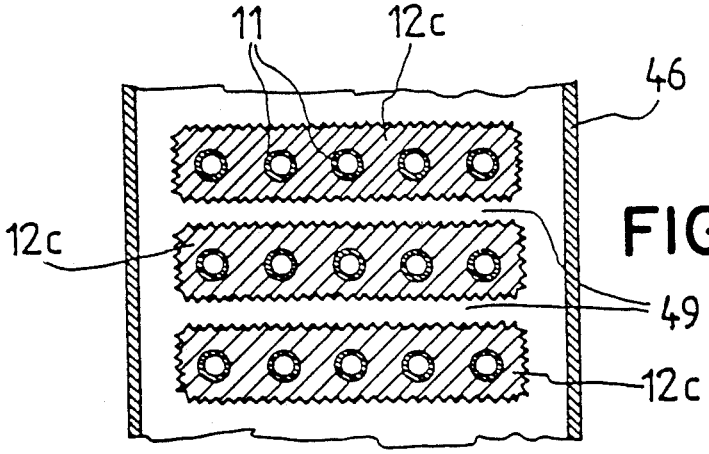
FIG. 14 shows a cross section taken along line XIV—XIV in FIG. 13.

FIGS. 13 and 14 show, schematically, a hot-water boiler 45 heated by exhaust gases from an internal combustion engine (not shown).

A number of panel-shaped blocks 12c, similar to that of FIG. 3, but each enclosing a larger number of tubes 11, are arranged side by side within a casing 46, through which hot gases flow from an inlet 47 to an exit 48. The panesl are fitted within the casing in such a manner that the gases are forced to pass also through passages 49 between the panels.

The tubes 11 are connected to distribution and collecting headers 50 and 51, respectively, and the boiler is proviced with conventional governing and supervision equipment (not shown).

The embodiments described above and shown in the drawings are examples only, and it is evident that the blocks of the basic type shown in FIG. 1 can be shaped and combined in many ways within the scope of the appended claims.

As is indicated in the lower part of FIG. 9 the gaps between the flanges may be defined by substantially parallel walls, the flanges thus obtaining flat edge surfaces. By making a centrally located flange at the individual blocks slightly higher than the adjacent flanges, it is possible to ensure a definite distance between the blocks, and furthermore the flow passage between the blocks will be subdivided into parallel paths.

An obvious advantage with the cast blocks is that they are more easy to clean than previous embodiments with parallel washers or discs mounted upon the tubes.

If the block panels with the embodiment according to FIGS. 13, 14 are mounted so that the flanges intersect as shown in FIG. 6 it is possible in a simple manner to determine the area of gas passages by parallel displacement of the block panels. In this manner it will be possible to vary the velocity of the gas flow, and thus also the heat transfer coefficient.

What is claimed is:

1. A heat exchanger comprising:

a core body enclosing therein a plurality of electric resistance elements, said core body being enclosed within a casing governing the flow of a heat-transporting medium outside said core body, said core body including a plurality of elongate blocks of a cast metal each having four side faces and a high heat-conducting capacity, at least one tube having a roughened outward face and enclosing at least one electric resistance element embedded in each said elongate block and integral therewith, the side faces of said blocks being each provided with outwardly projecting flanges having outer edges thereon and running parallel to the direction of elongation of said blocks for presenting contact surfaces to said heat-transporting medium, the flanged side faces of each of said blocks being cut by transverse grooves therein imterrupting and subdividing each said flanged side face into plural flanged sections, the flanges of each said flanged section being displaced laterally in relation to the flanges of a respective following section whereby the flanges of each said flanged section are aligned with gaps between the flanges of the respective preceding and following sections in the direction of flow, said blocks being packed closely together within said casing with said outer edges of juxtaposed flanges abutting together, a plurality of flow paths for said heat-transporting medium being defined by gaps between juxtaposed flanged side faces of said blocks and between outwardly facing side faces of said blocks of said core and said casing for thereby providing a plurality of tortuous flow passages for said heat-transporting medium along said faces of said blocks.

2. A heat exchanger according to claim 1, wherein said casing is provided adjacent one end thereof with inlet and outlet conduits for said heat-transporting medium, and said casing is provided with means therewithin for forcing said heat-transporting medium to make a 180° turn when flowing from said inlet conduit to said outlet conduit, and wherein said at least one tube is bent into a U-shape for presenting both end terminals of said at least one enclosed electrical resistance element at the opposite end of said casing.

3. A heat exchanger, comprising a core body enclosing therein a plurality of electrical resistance elements and enclosed in an outer casing with a clearance therebetween providing a passage for the flow of a heat-transporting medium over said core body, said core body including a plurality of elongate metal blocks each having four side faces and a high heat-conducting capacity, each of said blocks having cast therewithin at least one metal tube having a roughened outward surface and enclosing at least one electric resistance element, the side faces of said blocks having outwardly projecting flanges running parallel to the general direction of flow of said heat-transporting medium for contacting said heat-transporting medium, wherein each of said flanged faces is formed with grooves therein extending transversely to the direction of elongation of the blocks for subdividing each said flanges of each section being displaced in a sidewardly direction relative to the flanges in a following section so as to be aligned with the gaps between adjacent flanges in said following section in the direction of flow, said blocks being packed closely together within said casing to provide a plurality of flow paths for said heat-transporting medium between juxtaposed flanged side faces of said blocks and between outwardly facing flanged side faces thereof and said casing, thereby providing a plurality of tortuous flow paths for said heat-transporting medium along said flanged side faces of said elongate blocks.

4. A heat exchanger according to claim 3, wherein gaps between said outwardly projecting flanges are defined by substantially flat parallel walls, said flanges having flat edge surfaces, a centrally-located flange of each block being slightly higher than flanges adjacent thereto whereby a definite spacing distance between the blocks is ensured.

5. A heat exchanger, comprising a cylindrical core body enclosing therein a plurality of electrical resistance elements and enclosed within a tubular outer casing, said core body including a plurality of first elongated metal blocks each having four side faces and four second metal block elements having a cylindrical segment shape and a flat side face, each of said first and second blocks having cast therewithin at least one metal tube having a roughened outward surface and enclosing at least one electric resistance element, the four side faces of said first blocks and the flat side faces of said second blocks having outwardly projecting flanges running parallel to the general direction of flow there-over of a heat-transporting medium for contacting said heat-transporting medium, wherein each of said flanged faces is formed with grooves therein extending transversely to the direction of elongation of the blocks for subdividing each said flanged side face into plural adjacent sections, the flanges of each section being displaced in a sidewardly direction relative to the flanges in a following section so as to be aligned with the gaps between adjacent flanges in said following section, said blocks being packed closely together within said casing to provide a plurality of flow paths for said heat-transporting medium between juxtaposed flanged side faces of said blocks, thereby providing a plurality of tortuous flow paths for said heat-transporting medium along said flanged side faces of said blocks.

* * * * *